US009770088B1

(12) United States Patent
Rivers

(10) Patent No.: US 9,770,088 B1
(45) Date of Patent: Sep. 26, 2017

(54) WEARABLE MEDICINE CONTAINER

(71) Applicant: Tyrae K. Rivers, Golden, CO (US)

(72) Inventor: Tyrae K. Rivers, Golden, CO (US)

( * ) Notice: Subject to any disclaimer, the term of this patent is extended or adjusted under 35 U.S.C. 154(b) by 0 days.

(21) Appl. No.: 15/397,357

(22) Filed: Jan. 3, 2017

(51) Int. Cl.
*A45F 5/00* (2006.01)
*A44C 5/00* (2006.01)
*A61J 1/03* (2006.01)

(52) U.S. Cl.
CPC ..... *A45F 5/00* (2013.01); *A44C 5/003* (2013.01); *A61J 1/03* (2013.01); *A61J 1/035* (2013.01); *A45F 2005/008* (2013.01)

(58) Field of Classification Search
CPC ..... A45F 2005/008; A44C 5/003; A61J 1/03; A45C 2011/007
USPC ..... 224/219, 221, 222, 267; 220/780, 784, 220/786, 788, 4.24, 4.25; 63/1.4; 206/540
See application file for complete search history.

(56) References Cited

U.S. PATENT DOCUMENTS 75,458 A * 3/1868 Pratt ..... A45F 5/00 224/222
334,844 A * 1/1886 Briesen ..... A45F 5/00 224/221
712,148 A * 10/1902 Nash ..... A45F 5/004 224/221
749,995 A * 1/1904 Johnson ..... A44B 11/24 224/163
1,080,240 A * 12/1913 Tidd ..... A45F 5/00 224/196
1,115,136 A * 10/1914 Wallerstedt ..... A45F 5/00 224/221
1,163,173 A * 12/1915 Pusinelli ..... 206/37
1,325,607 A * 12/1919 Barber ..... 150/150
1,352,863 A * 9/1920 Zeitler ..... A44C 5/003 132/293
1,485,915 A * 3/1924 Hammel ..... A44C 5/003 132/293
1,486,178 A * 3/1924 Antelmi ..... A45C 11/22 224/221
1,508,940 A * 9/1924 Sedransky ..... A44C 5/003 224/221
1,573,239 A * 2/1926 Gilliland ..... B65D 81/18 206/0.81
1,584,205 A * 5/1926 Zaldo ..... A44C 5/003 132/294
1,594,215 A * 7/1926 Sides ..... A44C 5/0046 206/37

(Continued)

*Primary Examiner* — Justin Larson

(57) ABSTRACT

This invention includes an elastic wristband including a strap and an elastic receptacle for receiving a cap. The receptacle includes integrated notches for receiving latches on the cap. The cap includes a cavity for covering one or more pills placed atop the receptacle and is configured to fit into the receptacle of the wristband in a secure manner using the notches. Together, this creates an assembly where the user is able to store pills, tablets, and other small items in the cavity. In at least one embodiment, the wristband comprises of a flexible material. In at least one embodiment, the assembly includes multiple caps. In at least one embodiment, a cap includes a latch. In at least one embodiment, latches attach the cap to the body via the receptacle notches. In at least one embodiment, a cap protrusion may substantially conform or enclose a pill, tablet, other form of medication, or small item.

4 Claims, 6 Drawing Sheets

(56) References Cited

U.S. PATENT DOCUMENTS 1,609,481 A * 12/1926 McCarthy ..... A44C 5/003 131/241
1,623,994 A * 4/1927 Buchsbaum ..... A45D 33/006 122/58 R
2,255,999 A * 9/1941 Kuehner ..... A44C 5/0015 224/219
2,473,226 A * 6/1949 Sheldon ..... G04B 37/12 132/301
3,009,614 A * 11/1961 Humphner ..... A44C 5/003 224/219
3,010,627 A * 11/1961 Hoover ..... A24F 19/0064 131/241
3,157,326 A * 11/1964 Murphy ..... A44C 5/003 224/219
3,202,331 A * 8/1965 McKinstrie ..... B63C 11/02 224/221
4,034,884 A * 7/1977 White ..... B65D 21/08 220/788
D248,057 S * 5/1978 Heimler ..... D3/229
D275,900 S * 10/1984 Spector ..... D11/2
5,531,481 A * 7/1996 Wiltshire ..... B42D 5/005 224/219
5,687,890 A * 11/1997 Wanner ..... A44B 11/005 224/163
D388,010 S * 12/1997 Scheufele ..... D11/26
5,979,691 A * 11/1999 Von Holdt ..... B65D 43/0256 220/266
D423,723 S * 4/2000 Metcalf ..... D28/77
D429,383 S * 8/2000 Thorpe ..... D11/26
D451,422 S * 12/2001 Wenrich ..... D11/26
6,530,509 B1 * 3/2003 Davis ..... A45C 11/34 224/219
7,581,671 B2 * 9/2009 Erdie ..... B65D 43/021 220/345.3
7,681,755 B2 * 3/2010 Roesler ..... B65D 43/021 206/1.5
D625,216 S * 10/2010 Morgan ..... D11/26
7,815,334 B2 * 10/2010 Sherman ..... A45F 5/00 224/219
7,942,293 B2 * 5/2011 Lawrence ..... A45C 11/008 224/197
D720,641 S * 1/2015 Rummonds ..... D11/3
D735,068 S * 7/2015 Garcia Pla ..... D11/3
9,089,190 B2 * 7/2015 Booker ..... A44C 5/0023
D751,898 S * 3/2016 D'Anglade ..... D9/435
D752,469 S * 3/2016 Rastrick ..... D11/3
9,617,047 B2 * 4/2017 Goettke ..... B65D 45/34
2004/0040959 A1 * 3/2004 Menceles ..... B65D 21/0202 220/23.2
2004/0251285 A1 * 12/2004 O'Neill ..... A45F 5/00 224/221
2005/0242137 A1 * 11/2005 Fishman ..... A01K 11/00 224/221
2010/0237115 A1 * 9/2010 Booker ..... A44C 5/0023 224/267
2013/0140306 A1 * 6/2013 D'Anglade ..... B65D 15/04 220/4.28
2013/0206801 A1 * 8/2013 Delgatty ..... A45F 5/00 224/219
2015/0216285 A1 * 8/2015 Grainger ..... A45D 40/18 206/581

* cited by examiner

WEARABLE MEDICINE CONTAINER

SUMMARY OF THE INVENTION

The present invention provides a portable container for carrying medication in a secure, quickly accessible manner so that critical medications can be accessed when needed. The present invention provides a wearable medicine container. The wearable medicine container includes: a longitudinal strap forming a wristband; a receptacle integrally molded with the wristband, and a cap.

The present invention provides a wearable elastic medicine container. The wearable medicine container includes: a wristband having a first end, a second end, a first surface, and a second surface; a receptacle integrally molded with the wristband, the receptacle having a first end, a second end, a first surface, and a second surface, wherein the first end is coupled to the first end of the wristband and the second end is coupled to the second end of the wristband, wherein the first surface of the receptacle is flush with the first surface of the wristband; an outwardly extending circumferential rim around the second surface of the receptacle, wherein the outwardly extending circumferential rim has a first surface and a second surface; a first cavity at the first end of the receptacle, wherein the first cavity extends through the first surface of the receptacle to the second surface of the receptacle; a second cavity at the second end of the receptacle, wherein the second cavity extends through the first surface of the receptacle to the second surface of the receptacle; a cap having a first end, a second end, a first surface, and a second surface, including: a first inwardly extending flange on the first end of the cap, wherein the first inwardly extending flange is sized to form a first friction fit in the first cavity of the receptacle; a second inwardly extending flange on the second end of the cap, and wherein the second inwardly extending flange is sized to form a second friction fit in the second cavity of the receptacle.

BRIEF DESCRIPTION OF THE DRAWINGS

Embodiments of the invention may be best understood by referring to the following description and accompanying drawings, which illustrate such embodiments.

In the drawings.

Figure 1:
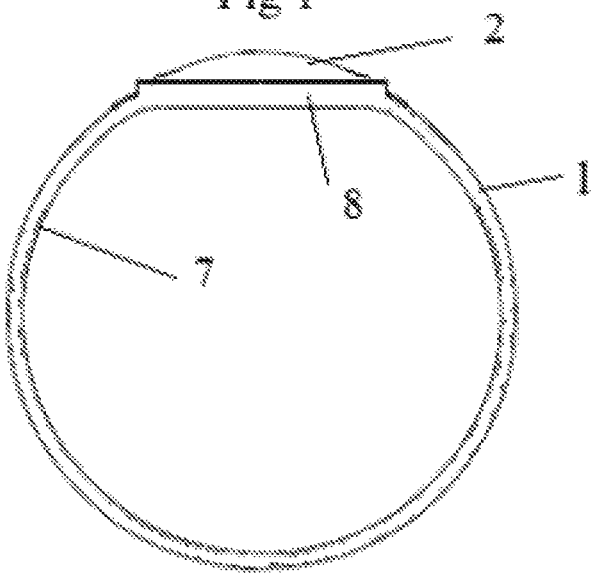
FIG. 1 is a perspective-view drawing illustrating an exemplary wearable medicine container with the cap.
Figure 2:
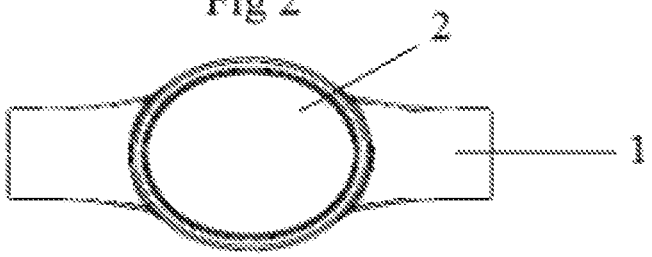
FIG. 2 is a perspective top-view drawing illustrating an exemplary wearable medicine container with the cap.
Figure 3:
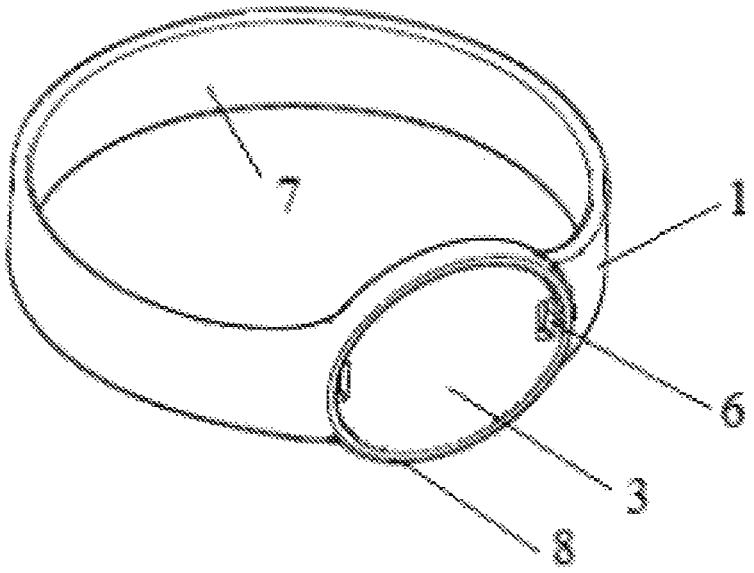
FIG. 3 is a perspective-view drawing illustrating an exemplary wearable medicine container with the cap removed.
Figure 4:
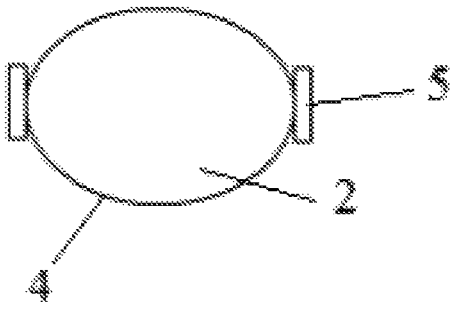
FIG. 4 is a perspective-view drawing illustrating a cap from an exemplary wearable medicine container.
Figure 5:
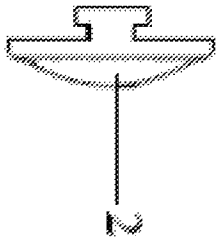
FIG. 5 is a perspective side-view drawing illustrating a cap from an exemplary wearable medicine container.
Figure 6:
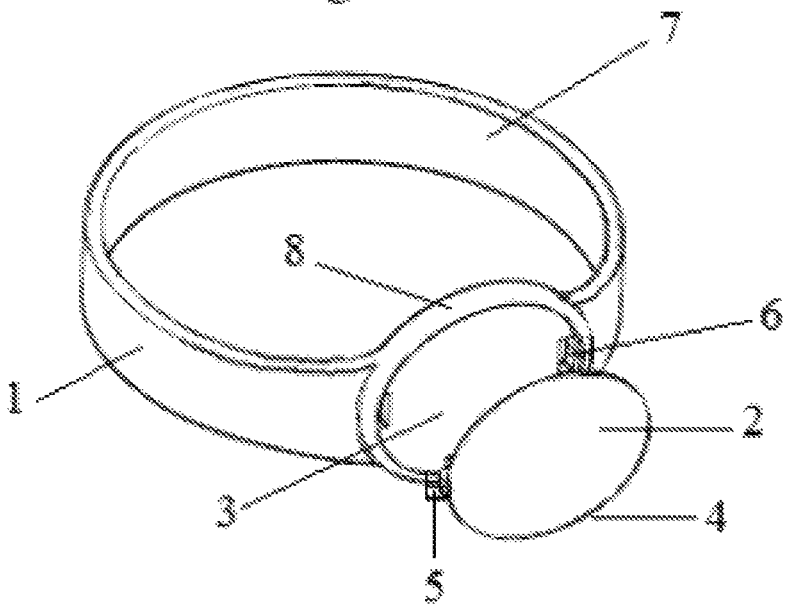
FIG. 6 is a perspective-view drawing illustrating an exemplary wearable medicine container with the cap slightly removed.

The drawings are not necessarily to scale. Like numbers used in the figures refer to like components, steps, and the like. However, it will be understood that the use of a number to refer to a component in a given figure is not intended to limit the component in another figure labeled with the same number.

DETAILED DESCRIPTION OF THE INVENTION

The present invention provides a portable container for carrying medication in a secure, quickly accessible manner so that critical medications can be accessed when needed. The present invention provides a wearable elastic medicine container.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense, and the scope of the present invention is defined by the appended claims and their equivalents.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the claims made herein.

The referenced items are provided solely for their disclosure prior to the filing date of the present application. Nothing herein is to be construed as an admission that the present invention is not entitled to antedate such material by virtue of prior invention.

Unless otherwise indicated, the words and phrases presented in this document have their ordinary meanings to one of skill in the art. Such ordinary meanings can be obtained by reference to their use in the art and by reference to general and scientific dictionaries, for example, Webster's Third New International Dictionary, Merriam Webster Inc., Springfield, Mass., 1993 and The American Heritage Dictionary of the English Language, Houghton Mifflin, Boston Mass., 1981.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise. It is further noted that the claims may be drafted to exclude any optional element. As such, this statement is intended to serve as antecedent basis for use of such exclusive terminology as "solely," "only," and the like in connection with the recitation of claim elements, or use of a "negative" limitation.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative apparatus. These terms are not meant to limit the element which they describe, as the various elements may be oriented differently in various applications.

As used herein, the term "cap" refers to a component for closing an opening in a structure or component of a device.

As used herein, the term "receptacle" refers to a structure or component of a device comprising a space for receiving and holding an object or another structure or component of the device.

As used herein, the term "rim" refers to an outer edge of a component of the present device, typically being circumferential.

As used herein, the term "strap" refers to a length of flexible material, generally used to secure another component.

As used herein, the term "wristband" refers to a length of flexible material which is designed to encircle the wrist of a subject.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Similarly, except as explicitly required by claim language, a single substance or component may meet more than a single functional requirement, provided that the single substance or component fulfills the more than one functional requirement as specified by claim language.

The wearable medicine container includes: a wristband 1; a receptacle integrally molded with the wristband 3, and a cap 2. The receptacle 3 may include the cap 2, which includes a retention lip 4 and two latches 5 on either side of said cap 2. The latches 5 on cap 2 may be inserted into the notches 6 contained within the receptacle 3 to seal the cavity. The cap 2 may be secured with the latches 5 and mates with the receptacle 3 with the retention lip 4. The receptacle 3 and the cap 2 will provide a storage cavity for the medicine contained within. The cap 2 may be inserted from the outer, side, or exterior surface of the chambered receptacle 3 contained within the wristband 1. When the cap 2 is inserted into the receptacle 3, a storage cavity is formed for the basis of storing medicine, pills, tablets, or other small items. FIG. 1 illustrates the wristband 1, a receptacle 3 integrally molded with the wristband 1, and a cap 2.

In at least one embodiment according to the present disclosure, as illustrated in FIG. 1, FIG. 2, FIG. 3, and FIG. 6, the wristband 1 takes form in the shape of a band to encircle the wrist of the user and secure the wristband 1 to the user. In at least one embodiment, the wristband 1 may be made of flexible material and may enable stretching, expansion, or contraction to facilitate installation and removal of said wristband. In at least one embodiment, the cap 2 may be made of a rigid material. In such an embodiment, the receptacle 3 may include a securing element or notch 6 to facilitate installation or removal of the cap 2.

The wristband 1 may facilitate impression, printing, or other display marking of a name, logo, mark, or words. The wristband 1 may include the body interior surface 7 which may be smooth for relative comfort for the user.

Marking faces may be located on the exterior surface of the cap 2. The marking faces may facilitate impression, printing, or other means of displaying a marking of a name, logo, mark, or words.

In at least one embodiment, the wristband 1 may have rounded edges. The wristband 1 may be a consistent thickness throughout. In at least one alternative embodiment, wristband 1 may have a thickness that varies along its length.

The storage cavity created by the cap 2 may be domed in geometry. In at least one embodiment, the cap 2 may have other geometries, including but not limited to circular, triangular, square, rectangular or oblong shapes. The retention lip 4 may be configured to engage the interior of the receptacle 3 and may enhance retention when installed or may prevent contamination by moisture or particulates. In at least one embodiment, retention lip 4 may include a ridge configured to interface with the interior of the receptacle 3. In at least one embodiment, cap 2 may interface with storage cavity sealing structure 3 to seal or retain the cap 2. In at least one embodiment, cap 2, receptacle 3, and retention lip 4, may include other shapes, including but not limited to round, square, triangular, or oval. In at least one embodiment, cap 2, receptacle 3, and retention lip 4, may include other types of seal interfaces including different materials or separate seals.

In at least one embodiment, the cap 2 may be disposable or replaceable. In at least one embodiment, the cap 2 may be made from silicone rubber or other flexible materials. In at least one embodiment, the cap 2 may be made from hard silicone, plastic, or other non-flexible materials. In at least one embodiment, the cap 2 may be different in size, color, or shape.

In at least one embodiment, the inside surface of the receptacle 3 may include a non-stick or other functional surface treatment. In at least one embodiment, the receptacle 3 may be divided into multiple regions or shapes. In at least one embodiment, there may be more than one receptacle 3. In at least one embodiment, there may be a dividing wall that separates two or more receptacles 3 that may be covered by one or more caps 2. In at least one embodiment, the wristband 1 may include more than one receptacle 3.

In at least one embodiment, the receptacle 3 may be formed around the pill, tablet, blister pack, or other form of medication during manufacturing and covered by the cap 2. In at least one embodiment, the cap 2 may be added later sealing the pill, tablet, blister pack, or other form of medication within the receptacle 3 until needed. In at least one embodiment, the cap 2 may be molded around the pill, tablet, tablet, blister pack, or other form of medication separately or at the same time as the body. For example, a tablet is placed into a mold for the cap 2 and the mold is filled with silicone covering the tablet, and when the mold is released, the cap 2 has been formed with a tablet inside the cap and is ready for use.

In at least one embodiment, the chambered wristband 1, of the present disclosure may be worn on the wrist. In another embodiment, the chambered wristband 1, may be worn on an ankle, or attached to a person.

While the disclosure has been illustrated and described in detail in the drawings in character, it being understood that only certain embodiments have been shown and described and that all changes and modifications that come within the spirit of the disclosure are desired to be protected.

All patents, patent applications, publications, scientific articles, websites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety. Additionally, all claims in this application, and all priority applications, including but not limited to original claims, are hereby incorporated in their entirety into, and form a part of, the written description of the invention.

Applicant reserves the right to physically incorporate into this specification any and all materials and information from any such patents, applications, publications, scientific articles, web sites, electronically available information, and other referenced materials or documents. Applicant reserves the right to physically incorporate into any part of this document, including any part of the written description, the claims referred to above including but not limited to any original claims.

What is claimed is:

1. A wearable medicine container comprising:

an elastic wristband having a first end, a second end, a first surface, and a second surface;

a receptacle integrally molded with the wristband, the receptacle having a first end, a second end, a first surface, and a second surface, wherein the first end is coupled to the first end of the wristband and the second end is coupled to the second end of the wristband, wherein the first surface of the receptacle is flush with the first surface of the wristband;

an outwardly extending circumferential rim around the second surface of the receptacle, wherein the outwardly extending circumferential rim has a first surface and a second surface;

a first cavity at the first end of the receptacle, wherein the first cavity extends through the first surface of the receptacle to the second surface of the receptacle;

a second cavity at the second end of the receptacle, wherein the second cavity extends through the first surface of the receptacle to the second surface of the receptacle;

a cap having a first end, a second end, a first surface, and a second surface, comprising:

a first inwardly extending flange on the first end of the cap, wherein the first inwardly extending flange is sized to form a first friction fit in the first cavity of the receptacle;

a second inwardly extending flange on the second end of the cap, and wherein the second inwardly extending flange is sized to form a second friction fit in the second cavity of the receptacle.

2. The wearable medicine container of claim 1, wherein the wristband is comprised of an elastic material.

3. The wearable medicine container of claim 1, wherein the receptacle is comprised of an elastic material.

4. The wearable medicine container of claim 1, wherein the cap is comprised of an elastic or ridged material.

* * * * *